United States Patent [19]

Kaneko et al.

[11] Patent Number: 4,552,009

[45] **Date of Patent: * Nov. 12, 1985**

[54] UPSETTER

[75] Inventors: Fuminori Kaneko; Takashige Yamamura, both of Kobe; Satosi Matsumoto, Toyonaka, all of Japan

[73] Assignee: Kabushiki Kaisha Kobe Seiko Sho, Kobe, Japan

[ * ] Notice: The portion of the term of this patent subsequent to Apr. 10, 2001 has been disclaimed.

[21] Appl. No.: 343,219

[22] Filed: Jan. 27, 1982

[30] Foreign Application Priority Data

Jan. 29, 1981 [JP] Japan ..... 56-13494

[51] Int. Cl.[4] ..... B21D 7/06; B21D 41/02

[52] U.S. Cl. ..... 72/316; 72/357; 72/452; 72/450; 72/416

[58] Field of Search ..... 72/305-307, 72/316, 317, 357, 358, 352, 353, 404, 432, 444, 450, 452, 465, 477, 478

[56] References Cited

U.S. PATENT DOCUMENTS

| | | | |
|---|---|---|---|
| 144,969 | 11/1873 | Evans | 72/449 |
| 880,567 | 3/1908 | Palmer | 72/316 |
| 1,633,970 | 6/1927 | Ball | 72/357 |
| 1,778,358 | 10/1930 | Glasner | 72/351 |
| 2,341,602 | 2/1944 | Dewey | 72/316 |
| 2,682,186 | 6/1954 | Riemenschneider | 72/478 |
| 2,796,109 | 6/1957 | Wood | 72/478 |
| 3,100,409 | 8/1963 | Esser et al. | 72/357 |
| 3,354,694 | 11/1967 | Schwartz | 72/452 |
| 3,991,681 | 11/1976 | Antosiak | 72/452 |
| 4,148,137 | 4/1979 | Kindig | 72/451 |
| 4,441,353 | 4/1984 | Asari et al. | 72/316 |

FOREIGN PATENT DOCUMENTS

| | | | |
|---|---|---|---|
| 2111988 | 11/1971 | Fed. Rep. of Germany | 72/452 |
| 39772 | 11/1965 | German Democratic Rep. | 72/395 |
| 8200 | of 1901 | United Kingdom | 72/452 |
| 781401 | 8/1957 | United Kingdom | 72/478 |
| 1045074 | 10/1966 | United Kingdom | 72/316 |

*Primary Examiner*—Daniel C. Crane

*Attorney, Agent, or Firm*—Oblon, Fisher, Spivak, McClelland & Maier

[57] ABSTRACT

An upsetter having a bed, a grip tong having one end thereof pivotally connected to one end of the bed, a row of split dies provided at the other free ends of the bed and grip tong and each having opposing upset die sections and clamp die sections, an upset mechanism including punches extractably protrudable into the dies, and a pair of pull rods pivotally supported on opposite sides of the dies to impart a required die closing force to the respective dies when tensioned, an upsetter mechanism for adjusting the tensile force of the pull rods to produce a desired die closing force which includes a clamping force closing the clamp die sections and a gripping force closing the upset die section in the forging stage, permitting adjustment of the clamping and gripping forces independently to each other.

11 Claims, 27 Drawing Figures

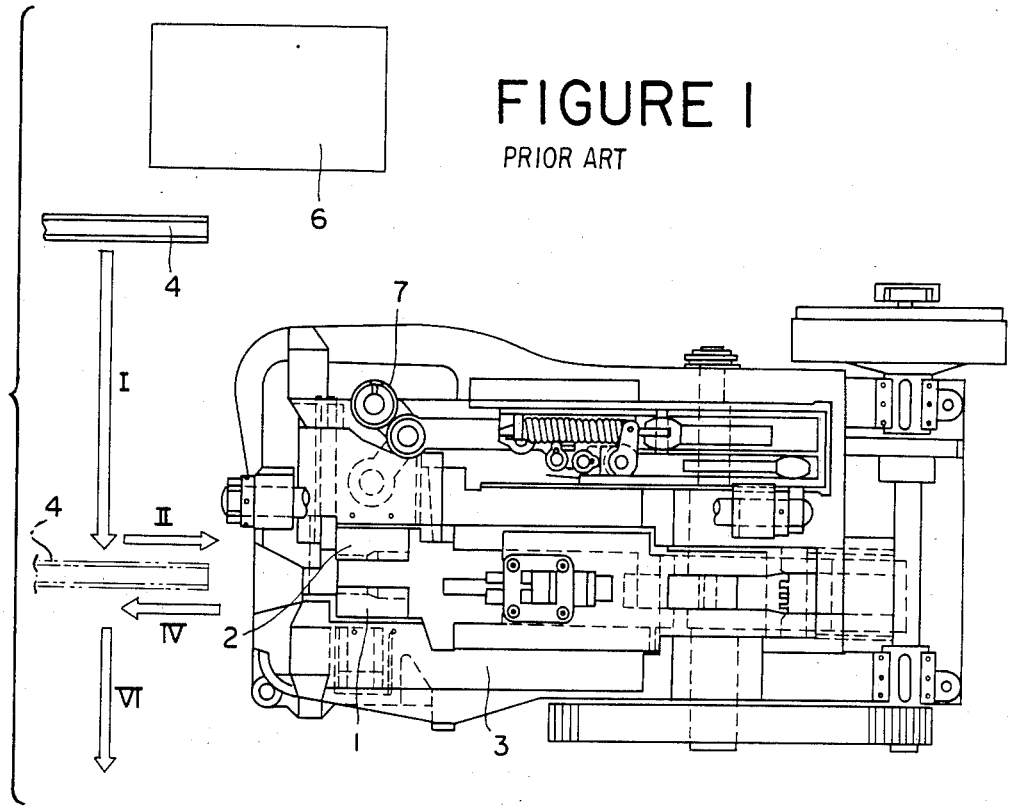
FIGURE 1
PRIOR ART
FIGURE 2
PRIOR ART
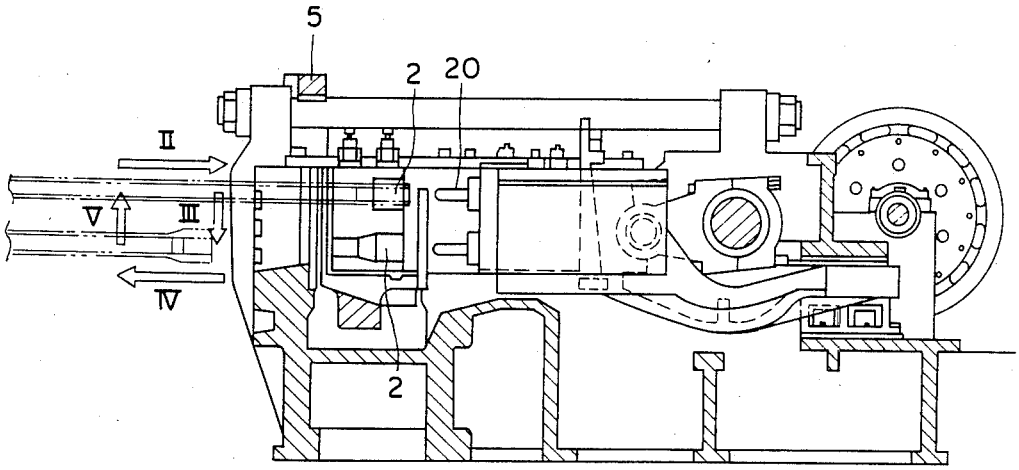

UPSETTER

BACKGROUND OF THE INVENTION

1. Field of the Invention

This invention relates to an upsetter for upsetting end portions of elongated work members of steel and like materials.

2. Description of the Prior Art

Known upsetters for upsetting end portions of lengthy work members are largely classified into a vertical type which has vertically split dies as illustrated in FIGS. 1 to 3 and a horizontal type which has horizontally split dies as illustrated in FIG. 4.

As seen in FIGS. 1 and 2, the vertical type upsetter is provided with vertically split dies 1 and 2 which are opened and closed in a horizontal direction by a drive mechanism which is provided at one side of the machine. The upsetter is provided with a U-shaped frame 3 which is open on the upper side and supports on its inner side the above-mentioned dies 1 and 2. In order to prevent the frame 3 from being expanded on the upper open side at the time of gripping a work member 4, a cross tie rod 5 is provided perpendicularly along the upper side of the frame 3.

Therefore, in the vertical type upsetter with the dies 1 and 2 enclosed on four sides as seen in the direction of arrow II of FIG. 2, there invariably arises the necessity of transferring the work member 4 over a relatively large distance to deliver the same to the front side of the machine and for moving the work in longitudinal directions when inserting and extracting it before and after the upsetting operation.

More specifically, as seen in FIGS. 1 and 2, a work member 4 which has its end portion heated in a furnace 6 is transferred horizontally over a certain distance for delivery to the working position of the upsetter as indicated by arrow I and then moved in the longitudinal direction for insertion into the upsetter as indicated by arrow II. Work member 4 which is inserted in the upsetter is then lowered stepwise as indicated by arrow III to undergo primary and secondary upsetting operations in the dies 1 and 2. Upon completion of the upsetting operation, the work member 4 is drawn out of the upsetter by moving the same longitudinally backward over a substantial distance as indicated by arrow IV and then lifted to the initial level as indicated by arrow V, followed by a horizontal movement over a large distance as indicated by arrow VI for transfer to the location of the next operation.

Consequently, the forming operation by a vertical upsetter entails transfer of the heated or upset work member 4 in a horizontal direction as indicated by arrow I or VI within a short time period in addition to substantial longitudinal movements in the directions of arrows II and IV. Namely, it has a drawback in that it requires complicated and costly transfer and handling mechanisms for moving the work in lateral, longitudinal and vertical directions. Besides, there has to be provided a long path of transfer in total to cope with the large breadth of the upsetter including the drive mechanism located at one side thereof, and the transfer of works in three different directions, resulting in a prolonged period of time for one cycle of operation, lower productivity and high production cost.

Especially, in the case of hot forging, the work members cool off while moved along the long path of transfer, so that greater force and energy are required for the upsetting operation and the number of consecutive operations which are possible per single heating is limited. Consequently, due to the difficulty of completing the forming operation with only one heating stage, there arise the necessities of die replacement and reheating of the work members before finishing the upsetting operation.

In order to eliminate these problems, there has been developed a horizontal type upsetter which, as seen in FIG. 4, is provided with a series of horizontally split dies 8 and 9. The dies 8 and 9 are opened and closed in the vertical direction by a drive mechanism which is located over the dies 8 and 9 to reduce the machine width.

As shown in FIG. 4, in the horizontal type upsetter, the work members which are passed horizontally through part of the split dies 8 and 9 are moved back and forth to evade interference with paired pull rods 11 which serve to maintain the gripping force of the dies 8 and 9. That is, the work members which are fed into the machine in a slightly retracted position to avoid the first pull rod 11 are pushed in and fed transversely to undergo sequentially the upsetting operations of the primary and secondary stages in the dies 8 and 9. Upon finishing the upsetting, the work members are retracted again to avoid interference with the second pull rod 11 before they are discharged from the upsetter for transfer to the location of the next operation.

The horizontal type upsetter which has a smaller width needs a shorter path of travel and thus contributes to shortening the cycle time of the upsetting operation and to enhancing the productivity as compared with the vertical type. Another advantage of the horizontal type upsetter resides in the fact that the transfer and handling mechanisms can be simplified to a significant degree as the main transfer routes are all on the same horizontal plane. Further, in contrast to the vertical type the dies of which are closed in a frame on four sides, a horizontal type upsetter permits observation of the conditions of the upset product with the naked eye from three sides when the dies are opened, so that some suitable measures can be taken promptly to remove the cause of any defect as soon as a defective product comes out.

Although the paths of travel of the work members in the horizontal upsetter are arranged two-dimensionally, that is to say, in one horizontal plane, the works have to be moved in longitudinal directions to evade collision against the pull rods 11 which move only a small distance in the longitudinal direction. Namely, there still remains the problem of utilizing a complicated transfer or feed mechanism in the known horizontal upsetter which is not constructed to transfer the works or products along a linear path of travel.

In the upsetters shown in FIGS. 1, 2 and 4, the upset die and clamp die sections of the respective dies are driven integrally so that it is difficult to adjust the clamping force and the upset die closing force independently of each other. Therefore, in order to securely clamp those work members which contain large variations in outside diameter, there should be provided a clearance between the clamp dies, which however gives rise to a problem in that the upset die closing force is varied due to variations in the outside diameter of the work members, resulting in a varying quality of the products.

Further, the die has an upset die section A and a clamp die section B independent of each other as shown particularly in FIG. 3 with hydraulic back-up devices C and D for the respective die sections so that there is a possibility of bending the work members due to a die centering error. In addition, the direct drive system utilizing crank E and F has another problem in that clamping pressures applied on the two dies differ in each clamping stroke by variations in stop position of a brake G. In order to eliminate the variations in clamping force, there has to be provided a hydraulic cylinder of a large stroke length, which however invites a large energy loss and necessitates the use of a clutch H with a large torque characteristic.

The clamp mechanism in either type of the above-described conventional upsetter is usually provided with unitary die holders 14 and 15 on die plates 16 and 17 for holding juxtaposed upper and lower dies 12 and 13, respectively, as seen in FIG. 23 which exemplifies a horizontal type upsetter, applying the clamping pressure by a hydraulic cylinder 19 which is provided in a tong head 18 integrally with the upper die plate 16. Therefore, in the particular example shown, when a couple of tubes which contain variations in outside diameter are simultaneously clamped, one clamp die which receives a tube of a smaller diameter fails to clamp it securely against a sliding deviation as caused by the punch 20 (see FIGS. 2–14) in the upsetting stage, failing to upset the two pipes simultaneously.

Such a clamping failure leads to a degradation of the product quality and to difficulty in the upsetting operation itself especially in the case of oil well tubes which have a relatively large tolerance in outside diameter as compared with other steel workpieces. In addition, the clamp mechanism of the conventional upsetter employs a hydraulic cylinder 19 of a fixed capacity so that it has been impossible to increase the clamping force and thus to adjust the power of the upsetter to a higher level when circumstances require.

SUMMARY OF THE INVENTION

It is therefore an object of the present invention to eliminate the above-mentioned drawbacks and problems of the conventional vertical and horizontal upsetters.

More particularly, it is a primary object of the present invention to provide an upsetter employing a novel grip mechanism which can hold the dies in a closed state, precluding the problem of lateral burrs which are produced when upsetting tubes particularly when upsetting tube ends which have a larger working area as projected in the radial direction of the tubes than their sectional area, due to a large force applied in the upsetting direction by the upsetting load in the forging stage. The grip mechanism thus contributes to the solution of the problems connected with the drop of product quality and the increase of operational cost.

According to one aspect of the present invention, this object is achieved by an upsetter including a bed, a grip tong having one end thereof pivotally connected to one end of the bed through a shaft, a row of split dies provided at the other opposing free ends of the bend and grip tong and each having an upset die section and a clamp die section, an upset mechanism having punches extractably protrudable into the dies, and a pair of pull rods pivotally supported on opposite sides of the dies to impart a required die closing force to the respective dies when tensioned, characterized in that the upsetter includes a mechanism for adjusting the tensile force of the pull rods to produce a desired die closing force which constitutes a clamping force for closing clamp dies to prevent axial dislacement of works and a gripping force for closing upset dies in the forging stage, and a mechanism for adjusting the clamping force independently of the gripping force.

It is another object of the present invention to provide an upsetter which can rigidly clamp a number of work members simultaneously irrespective of variations in outside diameter of the works and which can produce an increased clamping force in a simple and easy manner when necessary.

According to another aspect of the present invention, the foregoing object is attained by an upsetter including a bed, a grip tong having one end thereof pivotally connected to one end of the bend through a shaft, a row of split dies provided at the other opposing ends of the bend and grip tong and each having an upset die section and a clamp die section, an upset mechanism having punches retractably protrudable into the dies, and a pair of pull rods pivotally supported on opposite sides of the dies to impart thereto a required die closing force when tensioned, characterized in that the upsetter includes a plural N-number of pressurizing cylinders provided correspondingly to the respective dies to apply a clamping force separately to the clamp die sections thereof, an operating link for transmitting the forces of the pressurizing cylinders to the clamp die sections, (N−1) coupling members engageable with the operating link to transmit the combined force of the N-number of pressurizing cylinders to form one to (N−1) clamp die sections, and a mechanism for adjusting the tensile force of the pull rods to produce a desired die closing force which constitutes the clamping and gripping forces respectively closing the clamp and upset die sections, and a mechanism for adjusting the gripping force independently of the clamping force.

The above and other objects, features and advantages of the present invention will become apparent from the following description and the appended claims, taken in conjunction with the accompanying drawings which show by way of example preferred embodiments of the invention.

BRIEF DESCRIPTION OF THE DRAWINGS

In the accompanying drawings:

FIG. 1 is a plan view of a conventional vertical type upsetter;

FIG. 2 is a sectioned side elevational view of the upsetter of FIG. 1;

DETAILED DESCRIPTION OF THE PREFERRED EMBODIMENTS

Figure 3:
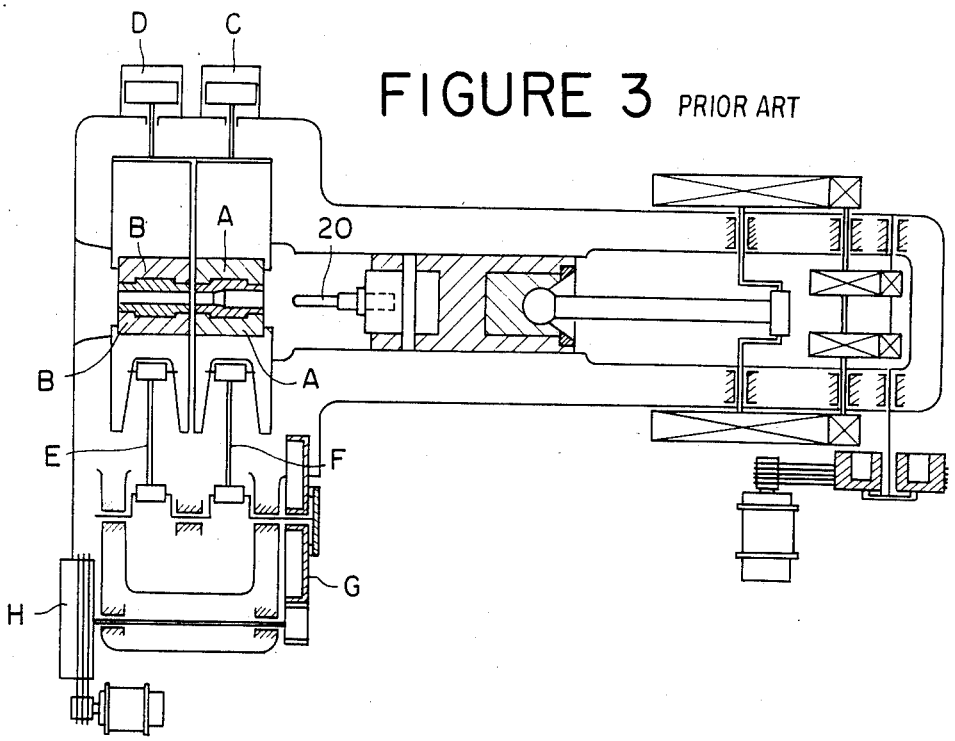
FIGURE 3 PRIOR ART
FIG. 3 is a diagrammatic view of a conventional drive mechanism and a die assembly of a vertical type upsetter different from the one shown in FIGS. 1 and 2.
Figure 4:
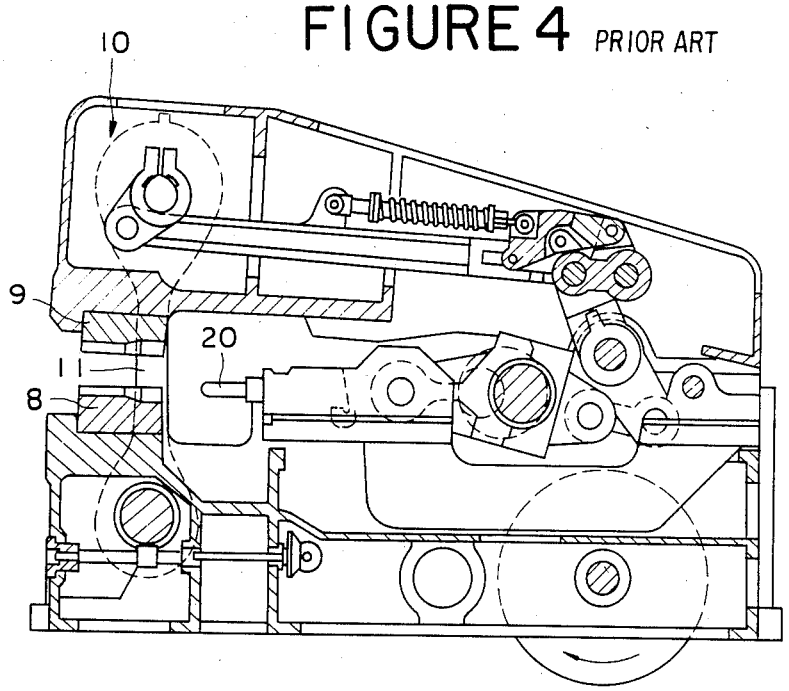
FIGURE 4 PRIOR ART
FIG. 4 is a sectioned side elevational view of a conventional horizontal type upsetter.
Figure 5:
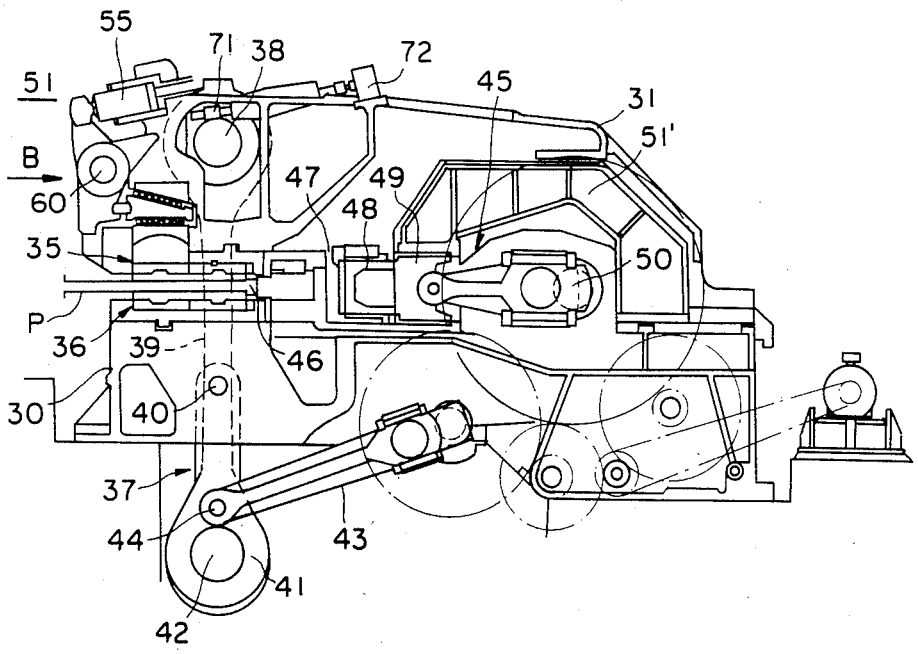
FIG. 5 is a sectioned side elevational view of an upsetter embodying the present invention.

Now, reference is made to FIG. 5 and the remaining FIGURES which illustrate preferred embodiments of the invention and of which FIGS. 5 to 22 depict upsetters which also overcome the above-mentioned problems concerning the path of work transfer in the conventional vertical and horizontal type upsetters, while FIG. 5 shows an embodiment with an upset slide cushioning mechanism which is arranged to absorb volumetric variations of works for preventing underfill or side burrs of upset products attributable to a large weight tolerance of the work members like oil well tubes which have a relatively large tolerance in both outside diameter and wall thickness.

The following description firstly deals with the outline of the upsetter with reference to FIG. 5 and then goes into the details of the grip mechanism of FIGS. 6 to 11 and the clamp mechanism of FIGS. 12 through 22. Referring to FIG. 5, the upsetter is provided with a bed 30 and a gripping tong 31 which are pivotally connected through a shaft 32 shown in FIG. 6. Provided transversely at the opposing ends of the bed 30 and tong 31 are a row of split dies 35 and 36 having upset die sections 33A, 33B and clamp die sections 34A, 34B.

The bed 30 and tong 31 are opened and closed by relative movement toward and away from each other through operation of a grip drive mechanism 37 which, in the particular example shown in FIG. 5, includes a pair of pull rods 39 pivotally supported on the tong head by an eccentric shaft 38, a pair of grip links 41 having a first end thereof pivotally supported on the bed 30 through a shaft 40 and opposite ends thereof pivotally supported by shaft 42 along with the pull rods 39, and a grip drive 43 pivotally supported by a shaft 44 between the links 41.

Indicated by reference number 45 is an upset mechanism which includes punches 46, a cylinder tube 47 detachably mounting thereon the punches 46, a piston 48 slidably fitted in the tube 47, a cross-head 49, and a drive unit 50, which are provided on a slide 51′ for retractably protruding the punches 46 into the dies 35 and 36. A relief mechanism, namely, a hydraulic cushioning mechanism which absorbs volumetric variations of works is provided between the drive unit 50 and upset slide 51′.

Figure 13:
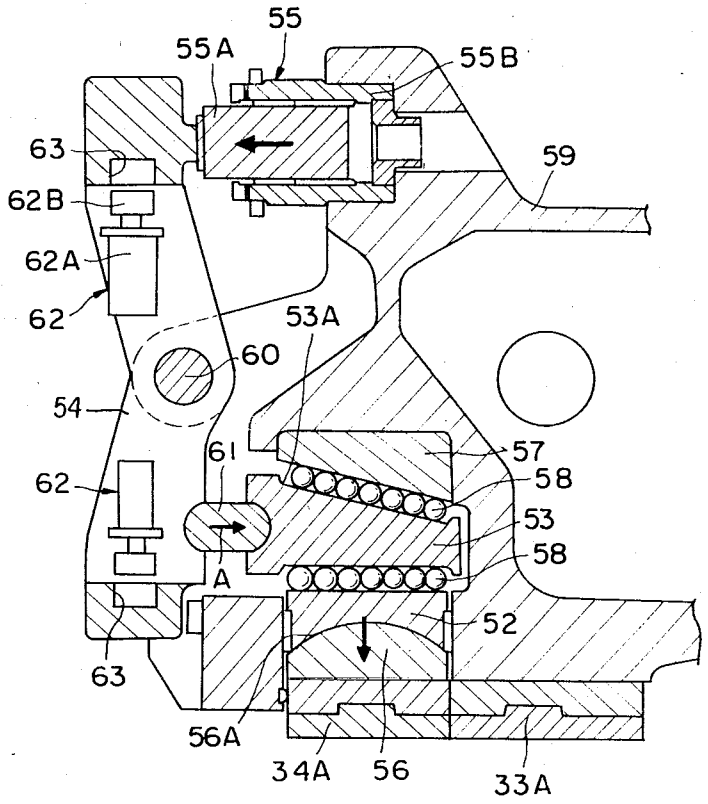
FIG. 13 is a sectioned side elevational view of the clamp mechanism of FIG. 5.
Figure 12:
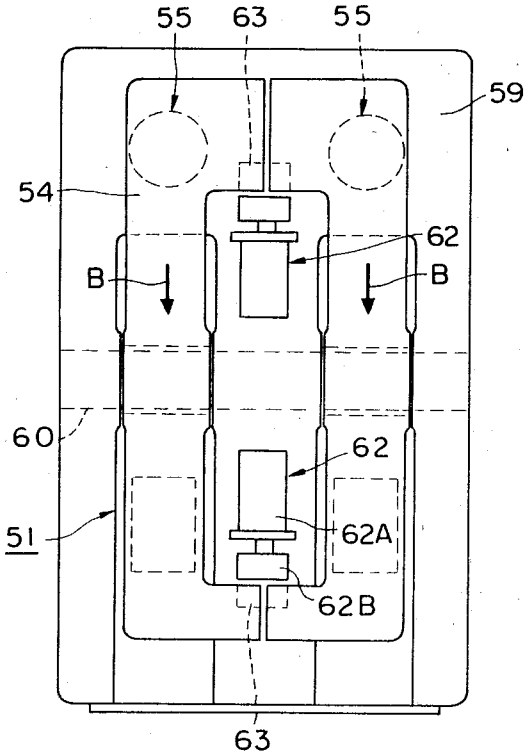
FIG. 12 is a front view of the clamp mechanism taken in the direction of arrow B of FIG. 5.
Figure 15:
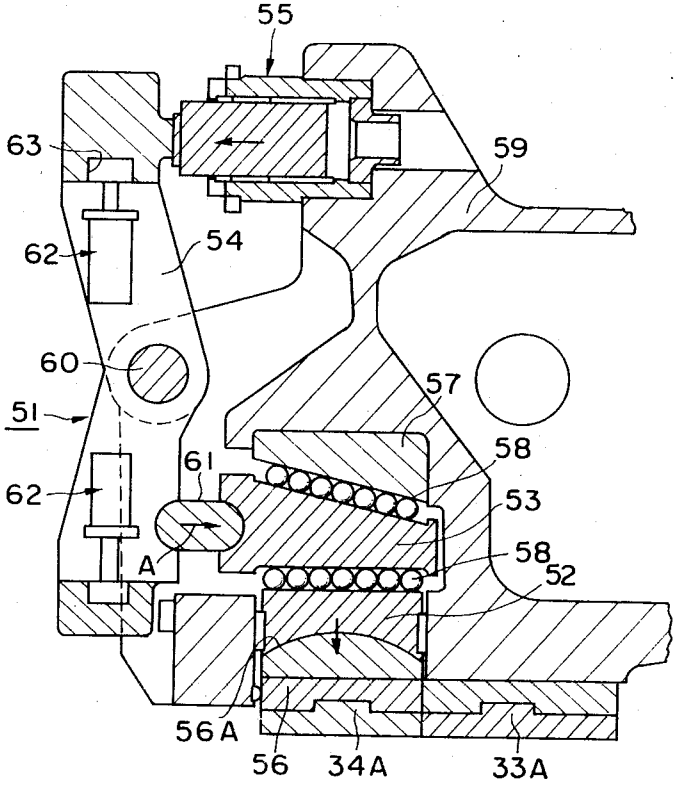
FIG. 15 is a sectioned side elevational view of the clamp mechanism of FIG. 5, in an engaged stage.
Figure 14:
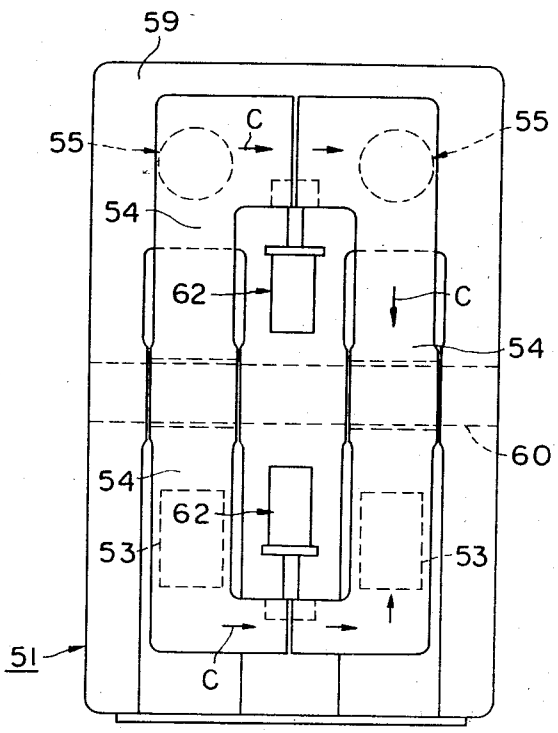
FIG. 14 is a view similar to FIG. 12 but showing coupling members in an engaged stage.
Figure 17:
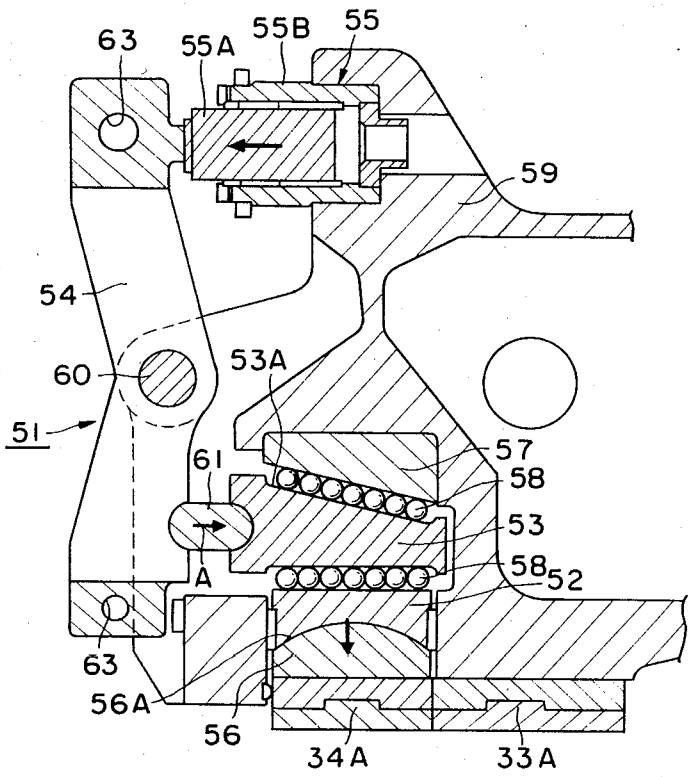
FIG. 17 is a sectioned side elevational view of the clamp mechanism of FIG. 5 but showing another embodiment of the invention.
Figure 16:
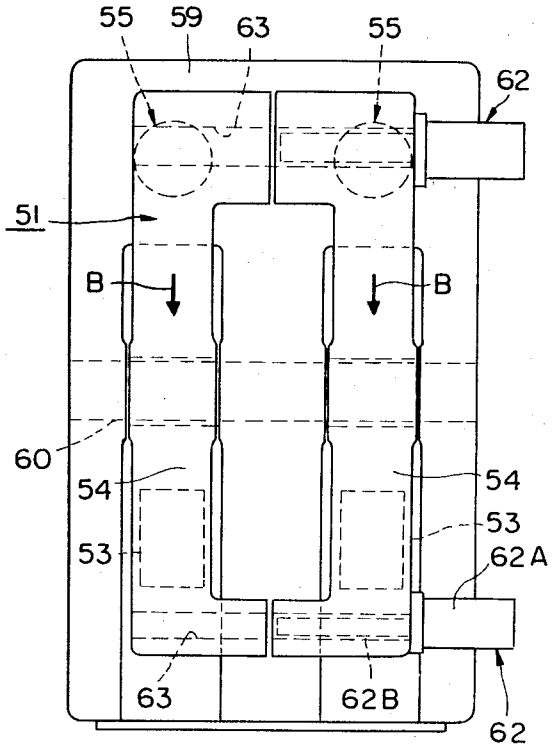
FIG. 16 is a view similar to FIG. 12 but showing another embodiment of the invention.
Figure 19:
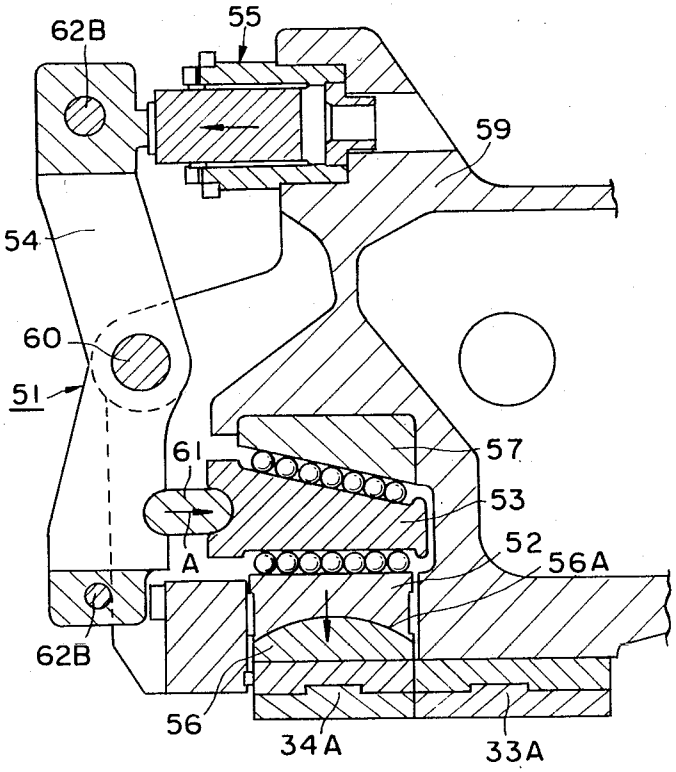
FIG. 19 is a sectioned side elevational view of the clamp mechanism of another embodiment.
Figure 18:
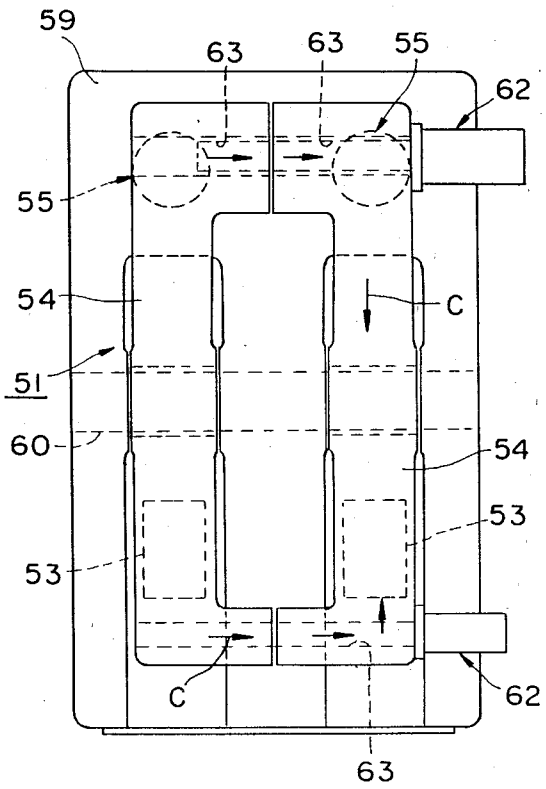
FIG. 18 is a view similar to FIG. 14 but showing another embodiment of the invention.

Reference number 51 denotes a clamp mechanism according to the present invention, which, in the particular embodiment shown in FIG. 13, has the movable clamp dies 34A each mounted on a slide block 52 through a die holder, and linked to pressurizing hydraulic cylinder 55 with a hydraulic cushioning function through a wedge block 53 and an actuator in the form of a clamp lever 54 (shown in FIG. 12).

Referring to FIGS. 6 through 11, the grip drive mechanism includes a drive source which is, in the particular example shown in those figures, a telescopic hydraulic cylinder 73 pivotally supported on the bed 30 by a shaft 70. Upon driving a worm shaft 71 (see FIGS. 8–11) which is meshed with the the eccentric shaft 38 through a bevel gear box 72 (shown in FIG. 5), the eccentric shaft 38 which constitutes the upper fulcrum point of the pull rods 39 is rotated, imposing on the dies 35 and 36 a die closing force F which is independently adjustable as indicated at $F_1$ and $F_2$ in FIGS. 10 and 11. On the other hand, the clamping force Fc on the work P can be independently adjustable by varying the fluid pressure of the hydraulic cylinders 55 in the tong head 59 in the case of FIGS. 6 and 7, as indicated at $Fc_1$ and $Fc_2$ in FIGS. 10 and 11. Thus, the closing force Fu of the upset dies 33A and 33B, a value expressed by the balance of the die closing force F and the clamp die clamping force Fc, can be set stably at a constant level independently of each other.

Figure 9A:
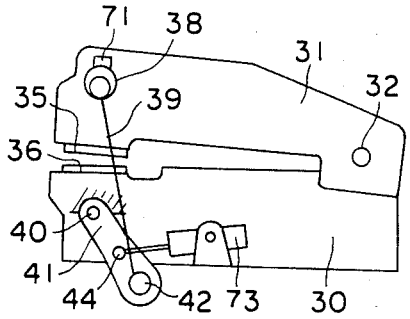
FIGS. 9(*a*) to 9(*c*) are diagrammatic illustrations showing operations of a grip drive mechanism.
Figure 9B:
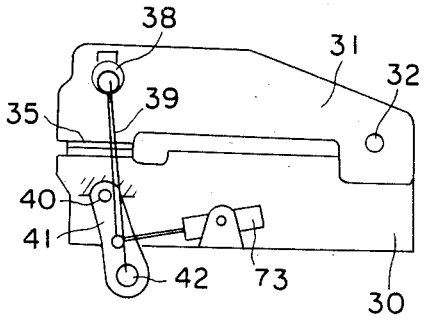
Figure 9C:
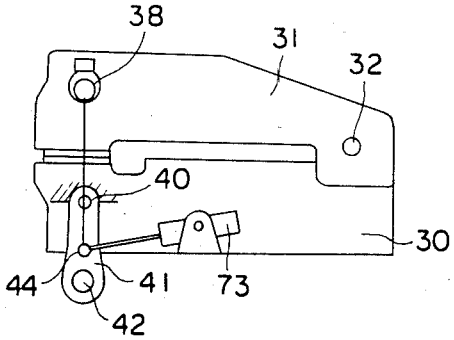
Figure 10B:
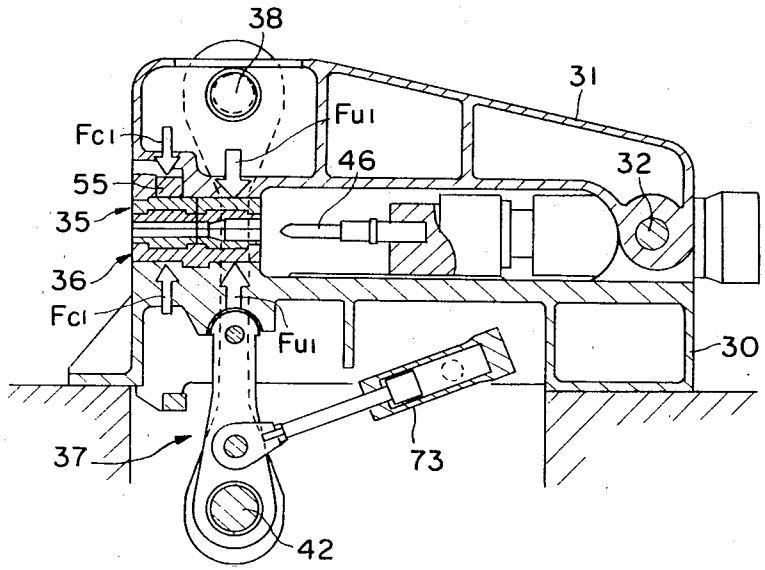
FIGS. 10(*a*), 10(*b*), 11(*a*) and 11(*b*) are sectioned side views and front elevational views employed to explain the die closing force of the upsetter.
Figure 10A:
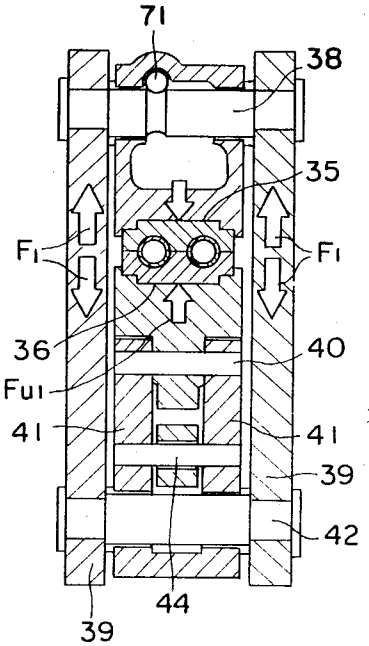
Figure 11B:
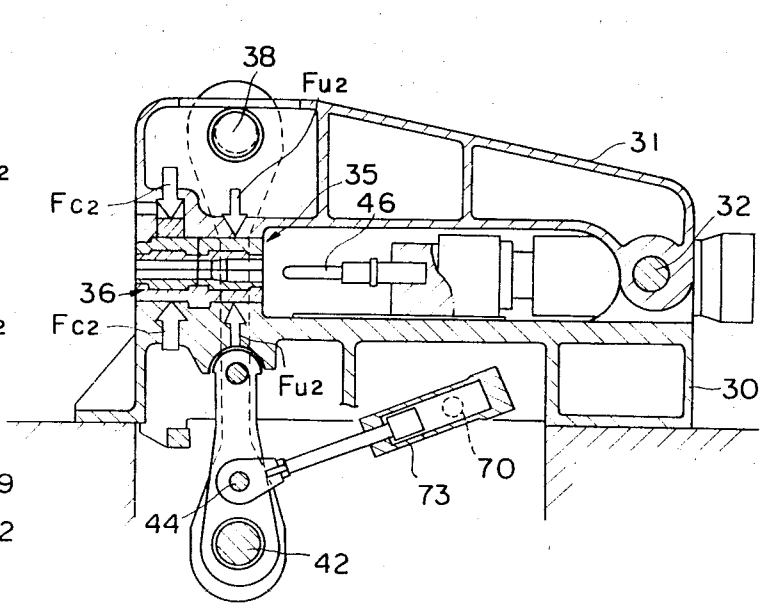
Figure 11A:
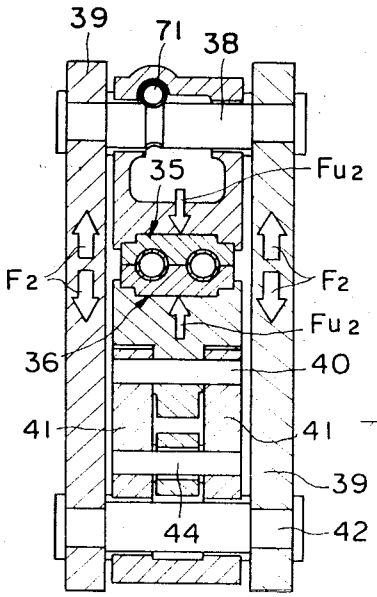

Reference is now made to FIGS. 9(*a*) to 9(*c*) to explain the operating principles in this regard. FIG. 9(*a*) illustrates the upsetter in a stage where the hydraulic cylinder 73 is contracted to open grip tong 31 against the bed 30 about the shaft 32 and thus the dies 35 and 36. In this stage, if the hydraulic cylinder 73 is extended, the grip links 41 are rocked clockwise about the shaft 40, causing the forward paired pull rods 39 to close the grip tong 31 toward the bed 30 by relative rotation about the shaft 32. When the dies 35 and 36 come into contact with each other, namely, at the stage shown in FIG. 9(*b*), the tensile forces of the pull rods 39 are zero. As the hydraulic cylinder 73 is further extended, the pull rods 39 are gradually pulled down and its tensile force becomes maximum when the eccentric shaft 38 and shafts 40 and 42 are aligned in a vertical plane as shown in FIG. 9(*c*).

Therefore, the pull rods 39 prevent the forced separation of the dies 35 and 36 when punches 46 of the upset mechanism 45 are driven thereinto in the upsetting stage. Namely, the pull rods 39 which are located on opposite sides of the dies 35 and 36 are tensioned by a sufficiently great force beforehand to impart a large gripping capacity to the dies. Although the gripping capacity varies depending upon the angular stop position of the grip drive brake (not shown), the variations in the gripping capacity are suppressed in the embodiment shown by the use of a link mechanism with two dead center points, which can minimize the variation to about 1% even if the accuracy of the brake stop position is supposed to be as large as $\pm 10°$. Thus, it ensures a sufficiently high gripping force in each cycle of operation to stabilize the quality of the products.

Further, as the worm shaft 71 is meshed with the eccentric shaft 38 through a bevel gear box 72 (shown in FIG. 5) or the like, the die closing force F can be freely and independently adjusted by varying the angular position of the eccentric shaft 38 which constitutes the upper fulcrum shaft, varying the elongation of the pull rods 39 for stepless adjustment of the die closing force F. Consequently, it becomes possible to constantly impart a required gripping force in a stable manner, precluding production of large lateral burrs which would appear when upsetting tube ends and at the same time overloading of mechanical parts.

Figure 6:
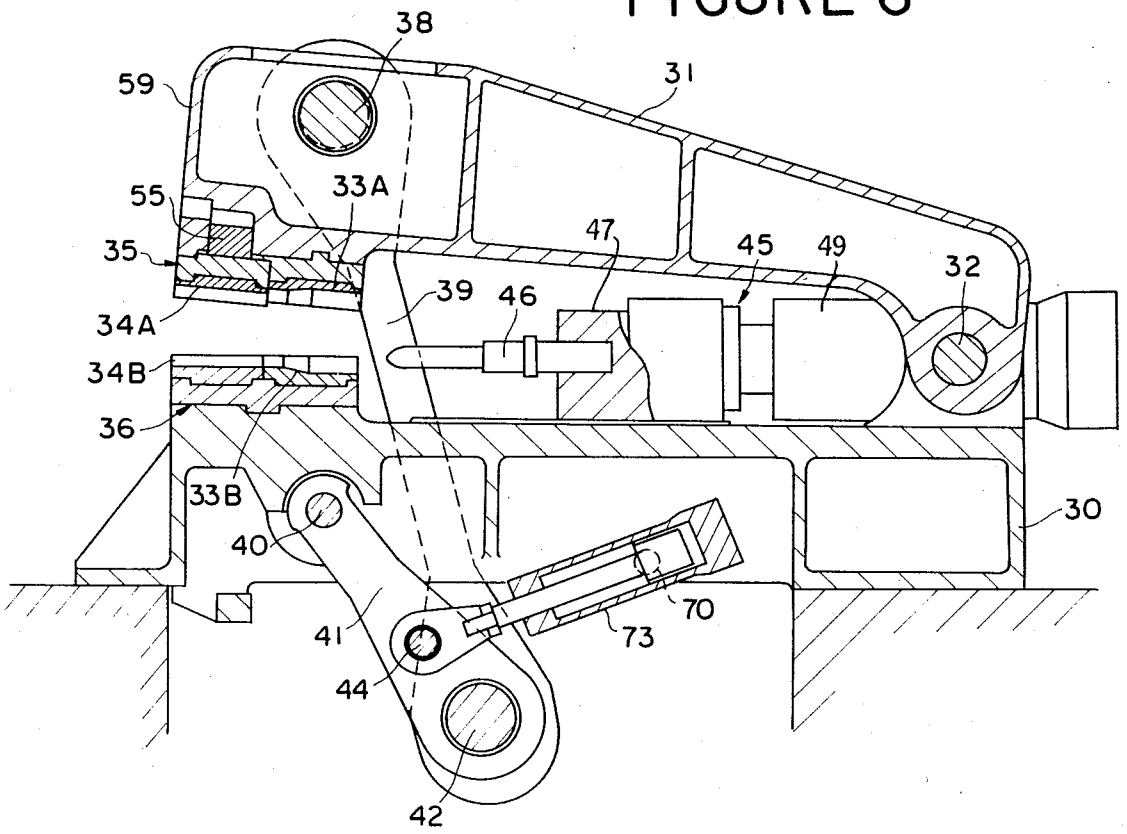
FIG. 6 is a sectioned side elevational view of a second upsetter of the invention in a die opening stage.

In addition, the pull rod type gripping mechanism of this embodiment permits movement of the blank tubes P or upset produces transversely along a linear path when feeding into or out of the machine since the pull rods 39 are located behind the die space portion when the grip tong 31 is opened, as seen particularly in FIG. 6. This contributes to shortening the transfer time and to improving the productivity, while permitting supervision of the dies 35 and 36 readily from three sides for checking the upsetting conditions.

Referring to FIGS. 5 and 12 to 22, there are shown other embodiments of the invention, which are provided with an improved clamp mechanism 51 in addition to the above-described pull rod type grip mechanism. A plurality of transversely aligned movable dies 34A, two in the particular example shown, are each mounted on a die plate 56 which is provided with a spherical seat 56A on the upper side thereof for fitting engagement with a cylindrical surface on the underside of a slide block 52.

Each wedge block 53 which has a wedge-like circumference 53A in the axial direction of the upset punch is fitted between the slide block 52 and an upper wedge plate 57 through bearings 58 like rollers or bushes for sliding movements in the axial direction of the punch. On the other hand, a clamp lever 54 is mounted on the tong head 59 opposingly to each wedge block 53, the clamp lever 54 having its middle portion rockably supported on a shaft 60 which extends perpendicularly to the axis of the upset punch. One end of each clamp lever 54 is operatively linked to the piston 55A of the hydraulic cylinder 55 which has its cylinder type 55B fixedly mounted on the tong head 59.

At the other end of each clamp lever 54, a push rod 61 is operatively connected to a wedge block 53 through a spherical joint. Therefore, the power of an N-number of cylinders 55 is transmitted to the wedge blocks 53 in the direction of arrow A through the push rods 61 as shown particularly in FIG. 13, separately operating the clamp dies 34A as indicated by arrow B in FIG. 5. Namely, the clamp dies 34A are separately driven by the sliding movements of the respective wedge blocks 53 in the direction of arrow A in FIG. 13 to clamp firmly the respective blank pipes P (not shown).

Designated by reference numbers 62 are coupling members, which in the particular example shown, include a pair of hydraulic cylinders with the respective cylinder tubes 62A mounted on the upper and lower portions of one clamp lever 54. The piston rods which are fitted in the cylinder tubes 62A are provided with coupling blocks 62B at the respective fore ends, which disengageably engage opposing upper or lower ends of adjacent clamp levers 54 for interlocking the same.

Namely, when the coupling members 62 are in a disengaged state, that is to say, in the position shown in FIGS. 12 and 13, the output power of the hydraulic cylinders 55 is transmitted separately through the respective clamp dies 34A as indicated by arrow B, magnifying the clamping forces by the wedging actions of the wedge blocks 53. If the piston cylinders of the upper and lower coupling members 62 are extended to engage the coupling blocks 62B in the locking recesses 63, the opposing clamp levers 54 are interlocked integrally with each other to apply the combined force of the two hydraulic cylinders 55 to one clamp die, as indicated by arrow C in FIG. 14, permitting an increase in the clamping force whenever a higher power is required.

Referring now to FIGS. 16 to 19, there is shown a second embodiment of the clamp mechanism according to the invention, which is same as the preceding embodiment shown in FIGS. 12 to 15 except that the coupling members 62 are adapted to disengageably be engaged in bores formed in the upper and lower end portions of the clamp levers 54. Although the coupling members 62 are provided on one clamp lever in the second embodiment, it is more preferable from the standpoint of weight balance to provide them on both clamp levers.

Figure 20:
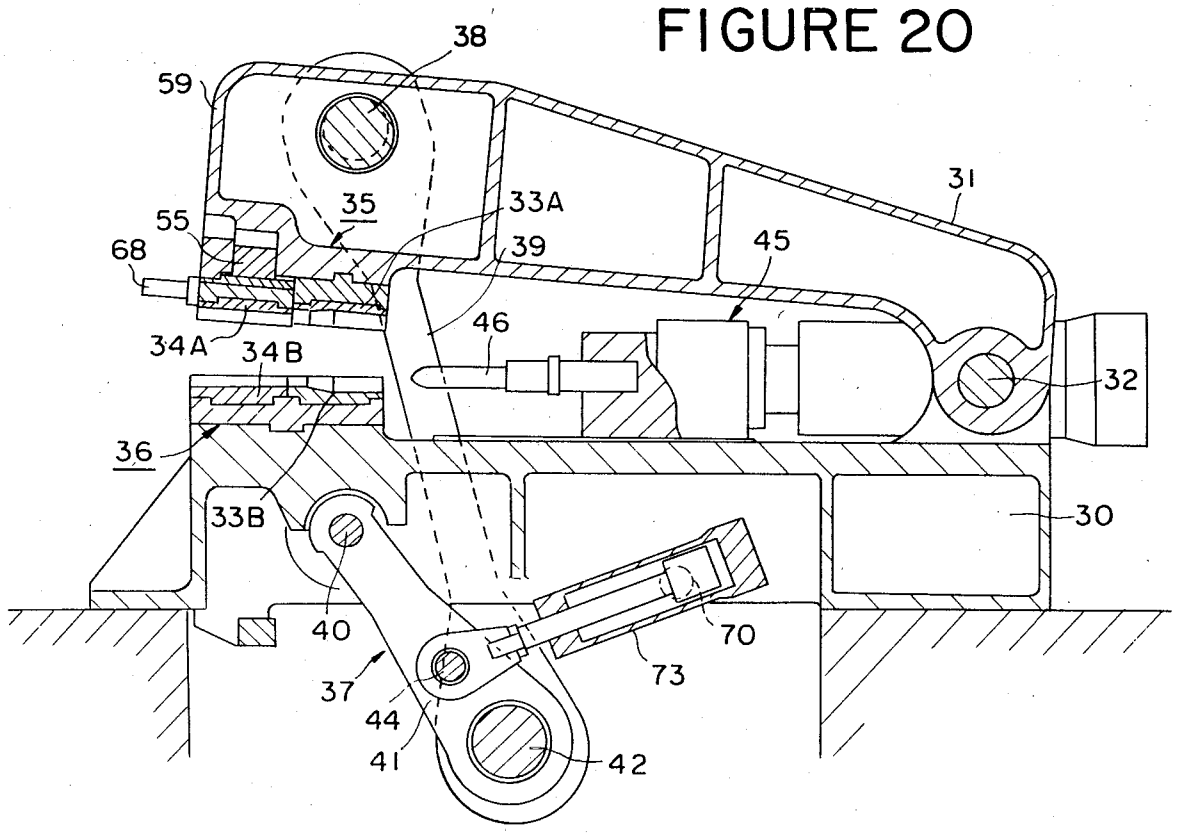
FIG. 20 is a sectioned side elevational view of still another embodiment of the invention.
Figure 21:
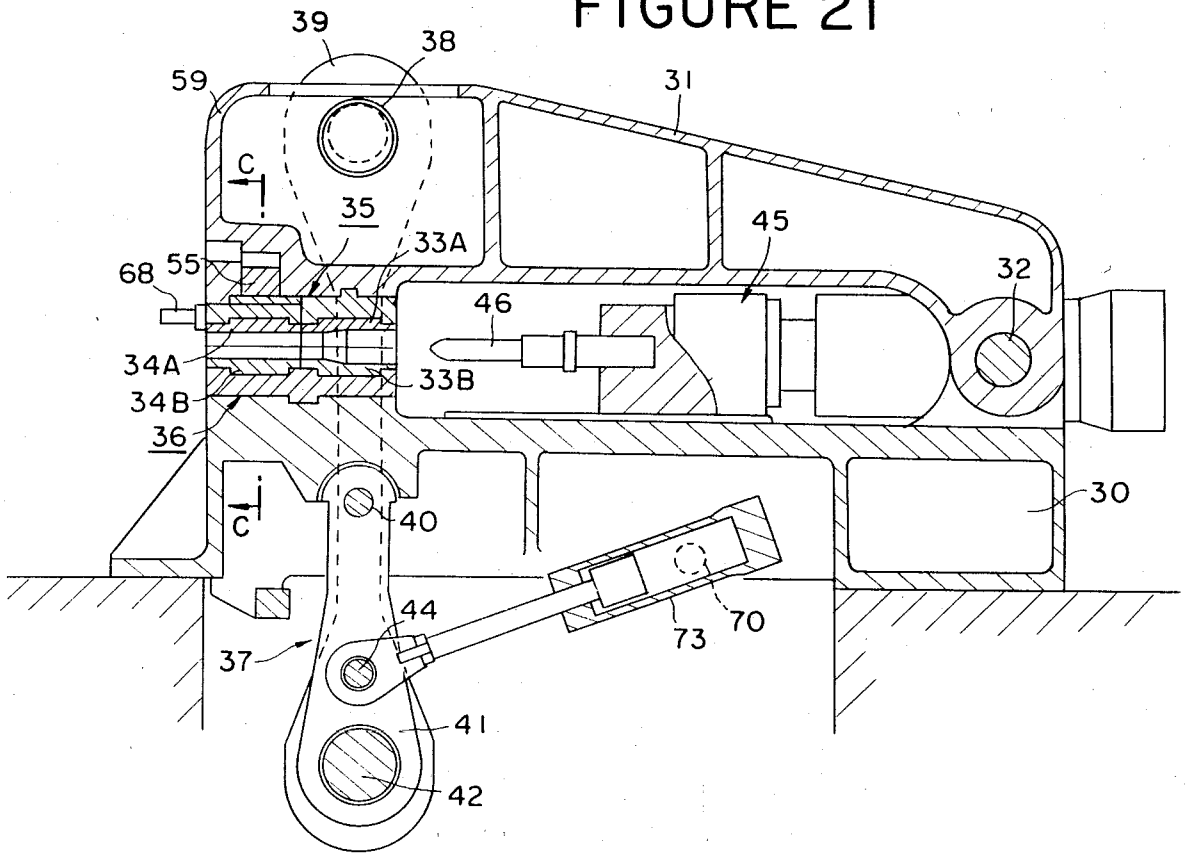
FIG. 21 is a view similar to FIG. 20 but showing the upsetter in a die closing stage.
Figure 22:
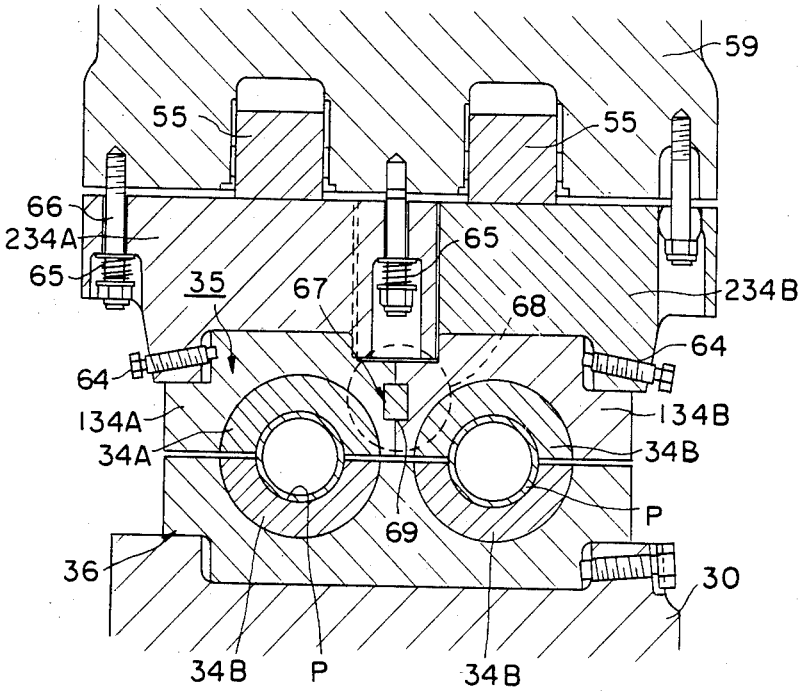
FIG. 22 is a cross sectional view taken on line C—C of FIG. 21.
Figure 23:
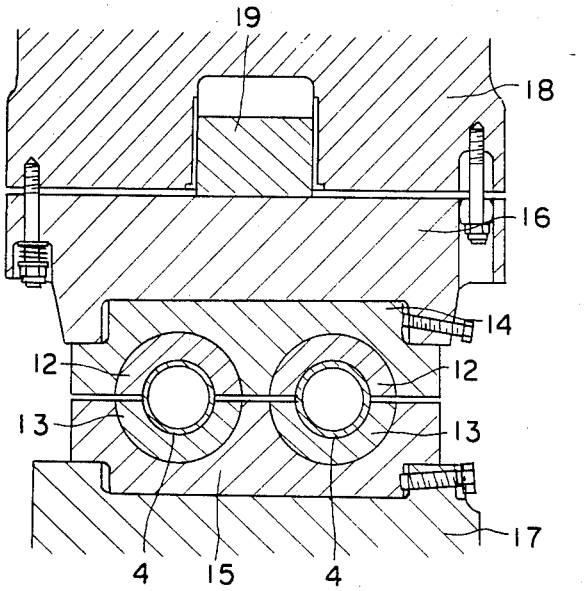
FIG. 23 is a view similar to FIG. 22 but showing a conventional counterpart.

FIGS. 20 to 22 illustrate a third embodiment of the invention, in which a plurality (N) of hydraulic cylinders 55 are formed side by side in the tong head 59 and the upper clamp dies 34A are provided in split die holders 134A and 134B which are in turn supported on split suspension blocks 234A and 234B through positioning bolts 64. Each one of the suspension blocks 234A and 234B is suspended from the tong head 59 by suspending bolts 66 through restorable resilient members 65 for vertical movement along the shank portions of the suspending bolts 66. The hydraulic cylinders 55 are provided separately for the respective suspension blocks 234A and 234B.

Thus, a plurality (N) of dies, a couple of dies 35 and 36 with upset dies 33A and 33B and clamp dies 34A and 34B in the third embodiment, are also provided successively in a row extending transversely of the upsetter, clamping separately a corresponding number of blank tubes with clamp dies 34A and 34B securely even when the tubes having different outside diameters.

Further, provided on the part of the tong head 59 is a coupling member which is, in this embodiment, constituted by a hydraulic cylinder 68 with a cotter 67. When the hydraulic cylinder 68 is extended, the cotter 67 is inserted in coupling grooves 69 which are formed in the adjoining surfaces of the split die holders 134A and 134B as shown particularly in FIG. 22. Therefore, in this embodiment, it is also possible to clamp a blank tube P firmly in either die 35 or 36 with an increased force by applying the combined force of the two hydraulic cylinders 55.

Figure 7:
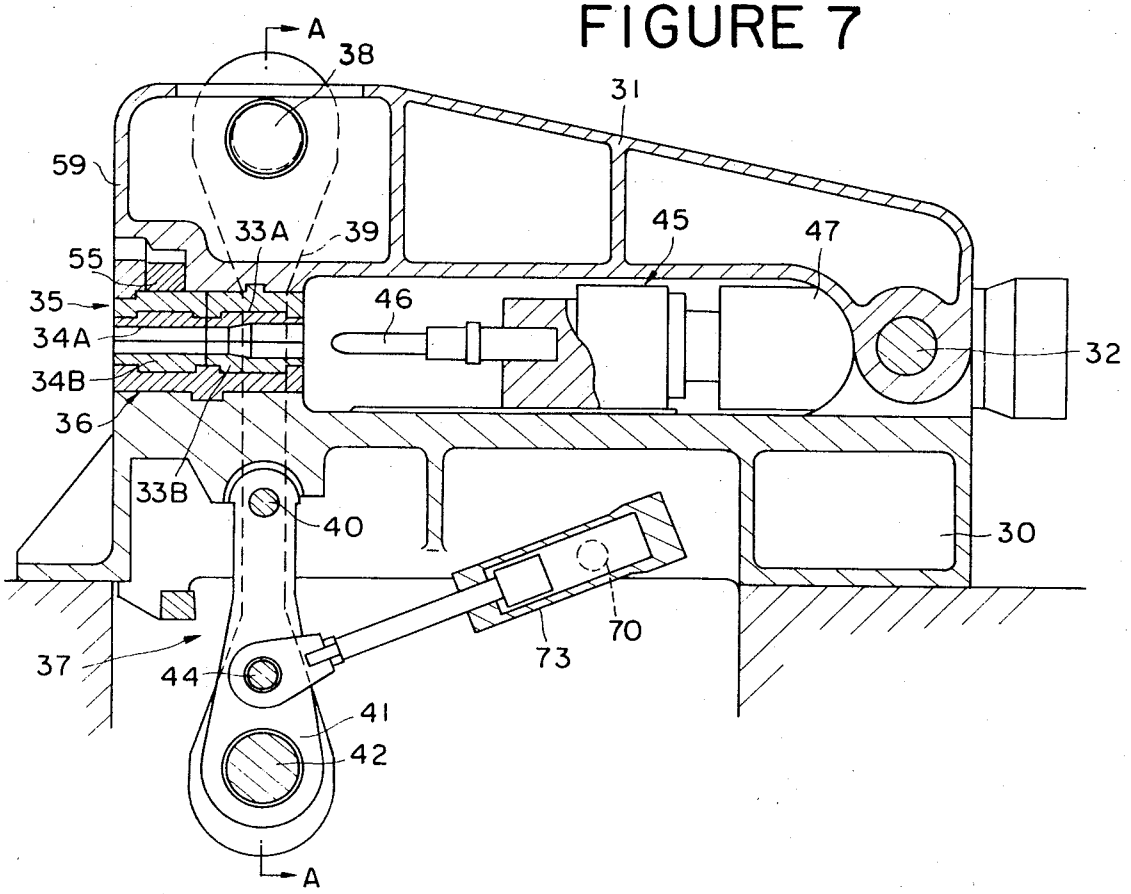
FIG. 7 is a view of the upsetter of FIG. 6 but showing the same in a die closing stage.
Figure 8:
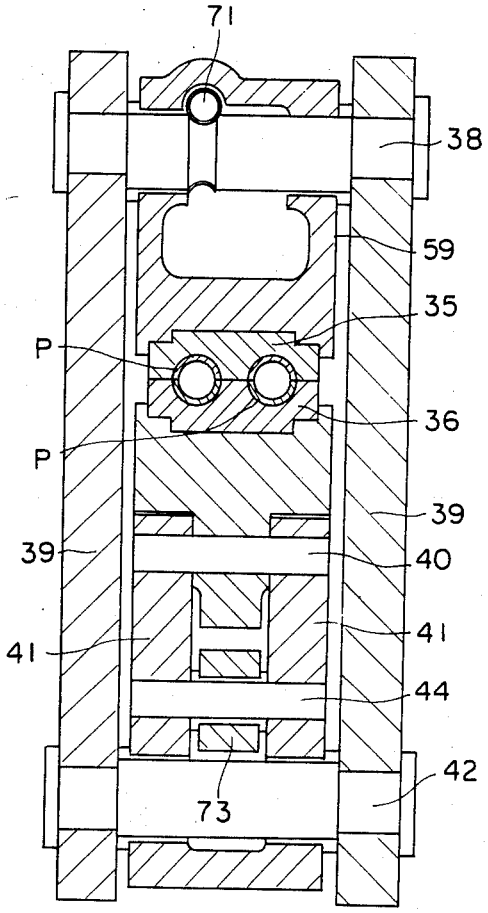
FIG. 8 is a cross sectional view taken on line A—A of FIG. 7.

The pull rod type grip mechanism and hydraulic cylinders 55 shown in FIGS. 20 and 21 are the same as in FIGS. 6 and 7, and like component parts are designated by like reference numerals.

The clamp mechanism of the present invention operates in the manner as described below. In an operation for upsetting tube ends, the clamp mechanism is required to prevent sliding deviation of blank tubes P by the upsetting force applied by the upset mechanism at the forging stage and by the punch drawing force in a stage immediately after the forging operation, and at the same time to be able to clamp firmly blank tubes P irrespective of a broad tolerance or variations in outside diameter of the work members in an upsetting operation handling simultaneously a plurality of blank tubes, since failure to satisfy these requirements will lead to an undesirable deformation or a drop in quality of the ultimate products. Therefore, in the first and second embodiments of the invention, the upsetter employs a wedge mechanism or a hydraulic cushioning mechanism which is adapted to transmit the power of a hydraulic cylinder through a wedge block.

As blank tubes P are fed to predetermined positions in dies 35 and 36 and the tong 31 is lowered to the lower dead center position, the dies 35 and 36 are closed by a predetermined gripping force. Although the upper clamp dies 34A begin to clamp the tubes P immediately before the lower dead center position, the power of the hydraulic cylinders are imposed on the clamp dies through the roller wedge mechanism including the wedge blocks 54 which have a cushioning effect according to variations in outside diameter of the tubes P. Consequently, the tubes P are gripped invariably with a stable and constant gripping force when the tubes contain variations in outside diameter. Besides, the roller wedge mechanism in the first and second embodiments is provided over the clamp dies 34A and 34B and arranged to receive the clamping force over a broad area, so that it can smoothly slide in its cushioning action to guarantee a required clamping force stably. The cylindrical surface of the slide block which is provided between the roller edge mechanism and a clamp die 34A serves to maintain the upper and lower clamp dies 34A and 34B parallel with the tube P so that the latter is stably held in the dies with a uniform gripping force.

Further, in the first and second embodiments, as the combined force of a plurality (N) of hydraulic cylinders 55 is transmitted to the respective clamp dies 34A separately through a link mechanism of clamp levers 54, the power of the gripping cylinder can be minimized depending upon the link ratio.

In the above-described first to third embodiments, the hydraulic cylinders 55 are provided correspondingly to N-number of clamp dies (two in the particular embodiments shown) which are located side by side on the machine to clamp N-number of blank tubes P separately and securely no matter whether the clamped tubes contain variations in outside diameter or are of different outside diameters. In addition to the improvement of productivity, this clamp mechanism prevents localization of load when a plurality (N) of tubes P are simultaneously upset by the upset mechanism including the punches 46, and thus contributes to improving the quality of products and prolonging the life of bearing portions of the machine.

Further, in the first to third embodiments of the invention, the clamping force can be magnified by engaging the coupling members 62, more particularly, by interlocking the two clamp levers 54 in the first and second embodiments or by unifying the split die holders 134A and 134B in the third embodiment, to clamp a single tube P firmly and stably by the combined force of the two hydraulic cylinders 55.

The upsetter of the invention which employs upset and clamp mechanisms 45 and 37 of the so-called separate drive system has the following advantages. When upsetting tube ends, the forging end portion of each tube normally has to be supported over its entire length by a mandrel portion of the punch 46 in order to prevent buckling on the inner periphery of the tube, using a long punch. Further, in the case of outside upsetting where the inside diameter of an upset portion is substantially the same as that of a blank tube, it is necessary to clamp the pipe firmly throughout the upsetting operation from a point in time immediately before the insertion of the punch 46 into the tube P to a point in time when the punch 46 has been completely withdrawn. Namely, oil well tubes require a far greater upset stroke as compared with other ordinary upset products.

According to the invention, the upset and grip mechanisms 45 and 37 are provided independently of each other for securing a long effective upset stroke, in other words, gathering stroke, driving the two mechanisms by separate clutches and brakes. As a result, it becomes possible to select freely the relative timing of their motions depending upon the upsetting method and length in such a manner as to effect the forging within the shortest time periods suitable for the oil well tubes to enhance the productivity thereof. In a case where an oil tube is taken in with the punch 46 by shrinkage when the withdrawal of the punch is delayed due to misupsetting or for other reasons, it is also possible to extract the punch 46 forcibly by increasing the gripping force. The upsetter of the invention thus achieves the objects as stated hereinbefore in an effective manner, and is especially suitable for upsetting oil well tubes—not to mention other elongated works of steel or like material.

Although the clamp mechanism is provided with a pair of hydraulic cylinders 55 for a pair of clamp dies 34A in the foregoing embodiments, it is to be understood that there may be provided more than three (N-number) hydraulic cylinders 55 opposingly to N-number of clamp dies for operating respective clamp dies separately and, if necessary, applying the combined clamping force of the hydraulic cylinders arbitarily to from one to (N−1) clamp dies by engaging the coupling member or members.

It is also to be understood that, although the invention has been shown and described in relation with the horizontal type upsetter, the invention is not restricted thereto and is applicable to the vertical type upsetter if the problem of work transfer can be ignored.

What is claimed as new and desired to be secured by Letters Patent of the United States is:

1. An upsetter comprising:

(a) a bed having a front end and a rear end;

(b) a grip tong having a rear end thereof pivotably connected to the rear end of said bed;

(c) a plurality of split dies provided at the front end of said bed and said grip tong, each of said plurality of split dies having an upset die section and a clamp die section;

(d) an upset mechanism mounted on said bed and including a plurality of punches each one of which is extractably protrudable into a corresponding one of said plurality of split dies;

(e) a pair of pull rods pivotably supported on said bed and on said grip tong rearwardly of said dies for imparting a required die closing force to said grip tong;

(f) first means for pivoting said pull rods back and forth between a first position in which said grip tong is pivoted to an open position and a second position in which said grip tong is pivoted to a closed position and said split dies are in their working positions;

(g) second means independent of said first means for adjusting the tensile force exerted by said pull rods when in their second positions; and (h) third means for applying a uniform clamping force to each of said clamp die sections during successive upsetting operations regardless of variations in the dimensions of the workpieces clamped therein during the successive upsetting operations.

2. An upsetter as recited in claim 1 wherein said second means comprise:

(a) an eccentric fulcrum shaft on which one end of each of said pair of pull rods is mounted and (b) fourth means for selectively rotating said eccentric fulcrum shaft so as to vary the fulcrum of said pair of pull rods.

3. An upsetter as recited in claim 2 wherein said fourth means comprise:

(a) a worm shaft operatively connected to said eccentric fulcrum shaft and (b) fifth means for rotating said worm shaft.

4. An upsetter as recited in claim 1 wherein said third means comprises:

(a) a plurality of pressurizing cylinders mounted on one of said bed or said grip tong, each of said plurality of pressurizing cylinders corresponding to and being operatively associated with a corresponding one of said plurality of clamp die sections;

(b) a plurality of operating link mechanisms for transmitting the force of each of said plurality of pressurizing cylinders separately to the corresponding one of said plurality of clamp die sections; and (c) sixth means for selectively coupling at least one of said plurality of operating link mechanisms to an adjacent one of said plurality of operating link mechanisms to thereby transmit the combined forces of the two of said plurality of pressurizing cylinders corresponding to the two coupled operating link mechanisms to a single one of said plurality of clamp die sections corresponding to one of the two coupled operating link mechanisms.

5. An upsetter as recited in claim 4 wherein said third means comprises sixth means for selectively coupling each of said plurality of operating link mechanisms to the adjacent one or ones of said plurality of operating link mechanisms to thereby transmit the combined forces of a plurality of said plurality of pressurizing cylinders corresponding to a plurality of coupled operating link mechanisms to a single one or a group of less than all of said plurality of clamp die sections corresponding to the coupled operating link mechanisms.

6. An upsetter as recited in claim 4 wherein said third means comprises:

(a) a plurality of pressurizing cylinders mounted on one of said bed or said grip tong, each of said plurality of pressurizing cylinders corresponding to and being operatively associated with a corresponding one of said plurality of clamp die sections and (b) a plurality of operating link mechanisms for transmitting the force of each of said plurality of pressurizing cylinders separately to the corresponding one of said plurality of clamp die sections.

7. An upsetter as recited in claim 1:

(a) and further comprising a plurality of split die holders each one of which receives a corresponding one of said plurality of split dies and (b) wherein said third means comprises a plurality of pressurizing cylinders mounted on one of said bed or said grip tong, each one of said plurality of pressurizing cylinders corresponding to and being operatively associated with one of said plurality of split die holders, whereby each of said plurality of clamp die sections can be operated separately by the associated one of said plurality of pressurizing cylinders acting through the associated one of said split die holders.

8. An upsetter as recited in claim 6 wherein each of said plurality of operating link mechanisms comprises:

(a) a transfer shaft mounted on one of said bed or grip tong;

(b) a clamp lever pivotably supported at a middle portion thereon on said transfer shaft and having a first end thereof operatively connected to a corresponding one of said plurality of pressurizing cylinders;

(c) a push rod operatively connected to the second end of said clamp lever;

(d) a wedge block operatively connected to said push rod and having a wedge portion slidable in the axial direction of the corresponding one of said plurality of clamp die sections, said wedge portion bearing against one side of the corresponding one of said plurality of clamp die sections such that the force exerted by the clamp die sections is a function of the axial position of said wedge portion.

9. An upsetter as recited in claim 8 wherein each of said clamp levers is pivotably mounted on the same transfer shaft.

10. An upsetter comprising:

(a) a bed having a front end and a rear end;

(b) a grip tong having a rear end thereof pivotably connected to the rear end of said bed;

(c) a plurality of split dies provided at the front ends of said bed and said grip tong, each of said plurality of split dies having an upset die section and a clamp die section;

(d) an upset mechanism including a plurality of punches each one of which is extractably protrudable into a corresponding one of said plurality of split dies;

(e) a pair of pull rods pivotably supported on said bed and on said grip tong rearwardly of said dies for imparting a required die closing force to said grip tong when tensioned;

(f) a plurality of pressurizing cylinders mounted on one of said bed or said grip tong, each of said plurality of pressurizing cylinders corresponding to and being operatively associated with a corresponding one of said plurality of clamp die sections;

(g) a plurality of operating link mechanisms for transmitting the force of each of said plurality of pressurizing cylinders separately to the corresponding one of said plurality of clamp die sections; and (h) sixth means for selectively coupling at least one of said plurality of operating link mechanisms to an adjacent one of said plurality of operating link mechanisms to thereby transmit the combined forces of the two of said plurality of pressurizing cylinders corresponding to the two coupled operating link mechanisms to a single one of said plurality of clamp die sections corresponding to one of the two coupled operating link mechanisms.

11. An upsetter as recited in claim 10 and further comprising sixth means for selectively coupling each of said plurality of operating link mechanisms to the adjacent one or ones of said plurality of operating link mechanisms to thereby transmit the combined forces of a plurality of said plurality of pressurizing cylinders corresponding to a plurality of coupled operating link mechanisms to a single one or a group of less than all of said plurality of clamp die sections corresponding to the coupled operating link mechanisms.

* * * * *